US007707941B2

(12) United States Patent
Bishop et al.

(10) Patent No.: US 7,707,941 B2
(45) Date of Patent: May 4, 2010

(54) CARTRIDGE ASSEMBLY FOR MULTIPLE PROJECTILES

(75) Inventors: Ben Bishop, Nailsworth (AU); Ramon John Bambach, Victoria Point (AU); James Michael O'Dwyer, Brisbane (AU); Vinod Puri, Redwood Park (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 12/273,702

(22) Filed: Nov. 19, 2008

(65) Prior Publication Data

US 2009/0120317 A1 May 14, 2009

Related U.S. Application Data

(63) Continuation of application No. 10/519,203, filed as application No. PCT/AU03/00773 on Jun. 20, 2003, now Pat. No. 7,464,649.

(30) Foreign Application Priority Data

Jun. 20, 2002 (AU) ..... PS 3037

(51) Int. Cl.
*F42B 12/56* (2006.01)

(52) U.S. Cl. ..... 102/438; 102/202

(58) Field of Classification Search ..... 102/202, 102/438

See application file for complete search history.

(56) References Cited

U.S. PATENT DOCUMENTS

| | | | | |
|---|---|---|---|---|
| 200,740 | A | | 2/1878 | Lyman |
| 390,232 | A | | 10/1888 | Hurst |
| 484,011 | A | | 11/1892 | Haskell |
| 1,376,530 | A | | 5/1921 | Greener |
| 1,447,023 | A | | 2/1923 | Kaiser |
| 2,866,412 | A | | 12/1958 | Meyer et al. |
| 3,139,795 | A | | 7/1964 | Altschuler |
| 3,283,719 | A | | 11/1966 | Grandy |
| 3,288,066 | A | * | 11/1966 | Stadler et al. ..... 102/430 |
| 3,395,478 | A | | 8/1968 | Harvey |
| 3,416,252 | A | | 12/1968 | Silsby |
| 3,421,244 | A | | 1/1969 | Reed |
| 3,686,999 | A | | 8/1972 | Francois |

(Continued)

FOREIGN PATENT DOCUMENTS

DE 208577 A 3/1909

(Continued)

*Primary Examiner*—Stephen M Johnson
(74) *Attorney, Agent, or Firm*—Blakely Sokoloff Taylor & Zafman LLP

(57) ABSTRACT

A cartridge assembly (10) for firearms or weapons, said cartridge assembly including a support body (11) having a central longitudinal channel (16) housing a plurality of projectiles (20, 22, 24) in end-to-end orientation and having a plurality of circumferential chambers (14), wherein each chamber houses (14*a*, 14*b*, 14*c*) at least one propellant charge (12*a*, 12*b*, 12*c*) and is located adjacent to a respective projectile; fluid communication means (18) included in the support body for communicating the products of a gaseous expansion of said propellant from a respective chamber (14) into said central longitudinal channel (16); whereby, upon initiation of a selected propellant charge (12*a*, 12*b*, 12*c*), the communicated products of gaseous expansion from a circumferential chamber force or eject a respective projectile (20, 22, 24) from the cartridge assembly (10). The propellant charges may comprise a volume of propellant material encased in a bag with an igniter.

23 Claims, 7 Drawing Sheets

U.S. PATENT DOCUMENTS

| | | | | |
|---|---|---|---|---|
| 3,815,271 | A | 6/1974 | Lynn | |
| 3,854,231 | A | 12/1974 | Broyles | |
| 4,807,532 | A | 2/1989 | Andersson et al. | |
| 4,846,069 | A | 7/1989 | Tasson et al. | |
| 4,858,533 | A | 8/1989 | Warrn | |
| 4,930,421 | A | 6/1990 | Macdonald | |
| 5,016,537 | A | 5/1991 | Pinson | |
| 5,042,388 | A * | 8/1991 | Warren et al. | 102/434 |
| 5,295,439 | A | 3/1994 | Carbone | |
| 5,834,684 | A | 11/1998 | Taylor | |
| 5,880,397 | A | 3/1999 | Crilly | |
| 5,886,289 | A | 3/1999 | Nixon et al. | |
| 6,138,395 | A | 10/2000 | O'Dwyer | |
| 6,142,056 | A | 11/2000 | Taleyarkhan | |
| 6,301,819 | B1 * | 10/2001 | O'Dwyer | 42/84 |
| 6,343,553 | B1 | 2/2002 | O'Dwyer | |
| 6,431,076 | B1 | 8/2002 | O'Dwyer | |
| 6,659,012 | B1 | 12/2003 | Grassl et al. | |
| 6,722,252 | B1 | 4/2004 | O'Dwyer | |
| 7,146,898 | B2 | 12/2006 | O'Dwyer | |
| 2007/0068414 | A1 | 3/2007 | O'Dwyer | |

FOREIGN PATENT DOCUMENTS

| | | | |
|---|---|---|---|
| DE | 2752844 | A1 | 8/1982 |
| DE | 4035325 | A1 | 5/1992 |
| DE | 102004002471 | A1 | 8/2005 |
| FR | 2792399 | A1 | 10/2000 |
| GB | 253867 | A | 4/1926 |
| WO | WO 00/62005 | | 10/2000 |
| WO | WO 03/006917 | | 1/2003 |

* cited by examiner

CARTRIDGE ASSEMBLY FOR MULTIPLE PROJECTILES

RELATED APPLICATIONS

This application is a continuation of U.S. patent application Ser. No. 10/519,203, filed Dec. 23, 2005, now U.S. Pat. No. 7,464,649 which is a non-provisional application of International Application No. PCT/AU2003/000773, filed Jun. 20, 2003, which claims the priority from Australian Patent Application No. PS 3037, filed Jun. 20, 2002. The disclosure of the above-identified applications is incorporated by reference herein in its entirety.

FIELD OF THE INVENTION

This invention relates to cartridges for projectile launchers such as firearms or weapons. In particular, although not exclusively, the invention relates to cartridges that contain multiple projectiles for sequential ejection from the cartridge. The invention is also concerned with the disposition and initiation of propellant charges in the cartridge for projectile ejection at varying kinetic energies.

BACKGROUND

There exists a generally preferable need to launch projectiles at high velocity from launchers such as firearms. High velocity at the muzzle end of the barrel of a firearm means that whatever the weight and dimensions of the projectile, a sufficiently large gaseous expansion event has been provided behind the projectile to eject the projectile at the muzzle velocity measured.

In addition to the above well known need is the strategic and actual advantage of firing a multitude of projectiles at about the same time in the same direction. Use of a firearm having such characteristics can satisfy some of the many military needs associated with direct and indirect fire weapons and firearms usage in offensive and defensive environments.

SUMMARY OF THE INVENTION

Object of the Invention

The invention, at least in a preferred form, seeks to provide a cartridge from which multiple projectiles can be sequentially fired at a rapid rate and at high muzzle velocity, which cartridge is useable in a variety of firearms ranging from hand-held small caliber arms to large caliber weapons.

Desirably, the invention may also provide a cartridge containing multiple projectiles and each projectile having an associated propellant charge that can be individually initiated in a predetermined timing arrangement to eject the associated projectile into the barrel of a firearm at velocities that are useful in required circumstances.

Disclosure of the Invention

In a very broad aspect of the invention, a cartridge assembly includes a support body, the support body has a central longitudinal channel housing a plurality of projectiles in end-to-end orientation. The support body also has a plurality of circumferential chambers, each chamber houses at least one propellant charge and is located adjacent to a respective projectile. The support body further includes fluid communication means for communicating the products of a gaseous expansion of said propellant from a respective chamber into said central longitudinal channel. The communicated products of gaseous expansion from a circumferential chamber thus force or eject a respective projectile from the cartridge assembly.

Fluid communication means is preferably provided by a plurality of apertures included in said support body, suitably in a tubular wall portion thereof.

Most preferably, the propellant charges are sealed or encased in their respective chambers. The propellant charges may be sealed by providing obturation means for said plurality of apertures, which obturation means may be adapted to be expelled upon initiation of said propellant charge. The obturation means may comprise plug members seated with the apertures or an adhesive tape wrapped about the support body and over said apertures. Suitably the adhesive tape includes aluminum foil.

Alternatively said propellant charges may be encased in a bag formed, for example, by a metallic foil.

If required, each of the plurality of projectiles is disposed in abutting end-to-end orientation within the channel.

Preferably the support body of the cartridge assembly is unitary and may be substantially cylindrical in shape. Preferably the cylindrical shape of the support body assembly tapers from the rear end towards the forward, muzzle end of the cartridge In another broad aspect of the invention a cartridge assembly includes a unitary support body, the support body has a central longitudinal channel housing two or more projectiles in abutting end to end orientation. The support body also has two or more circumferential chambers located adjacent a respective projectile. Each chamber houses a propellant charge and the support body further has two or more apertures for communicating the products of a gaseous expansion of said propellant from a respective chamber into said central longitudinal channel. The communicated products of gaseous expansion from a circumferential chamber thus force a respective projectile from the cartridge assembly.

Preferably, the outer shape of the support body of the cartridge assembly is cylindrical. Preferably the cylindrical shape of the support body assembly tapers from the rear end towards the forward, muzzle end of the cartridge.

In yet another aspect of the invention the support body may have transverse annular walls forming ends of said circumferential chambers. The tubular wall portion of the support body which wall is otherwise a barrier between the inside of a chamber and the central longitudinal channel, suitably has said plurality of apertures therein.

A cylindrical cover is suitably arranged about the outer periphery of the substantially cylindrical support body to close off the radially outward opening of the circumferential chambers. Alternatively, the circumferential chambers may be closed off by an outer wall integrally formed with the support body.

The cover or outer wall is adapted to form, in use, a containment barrier to the products of gaseous expansion of propellant, whereby the only path of escape from the chamber is through said apertures in the tubular wall between the chamber and the central longitudinal channel.

In a further aspect of the invention, there is provided a cartridge assembly including a support body having a central longitudinal channel housing a plurality of projectiles in end-to-end orientation and having a plurality of circumferential chambers, wherein each chamber houses several propellant charges and is located adjacent to a respective projectile; a plurality of sub-chambers formed in each circumferential chamber for accommodating a respective propellant charge of said several propellant charges; and fluid communication means included in the support body for communicating the products of a gaseous expansion of said propellant from a respective sub-chamber into said central longitudinal channel.

BRIEF DESCRIPTION OF THE DRAWINGS

Specific embodiments of the invention will now be described in some further detail with reference to and as illustrated in the accompanying drawing figures. The described embodiments are illustrative, and not meant to be restrictive of the scope of the invention. Suggestions and descriptions of other embodiments may be included within the scope of the invention but they may not be illustrated in the accompanying figures or alternatively features of the invention may be shown in the figures but not described in the specification. The drawings of the embodiments are as follows.

DETAILED DESCRIPTION

Figure 1:
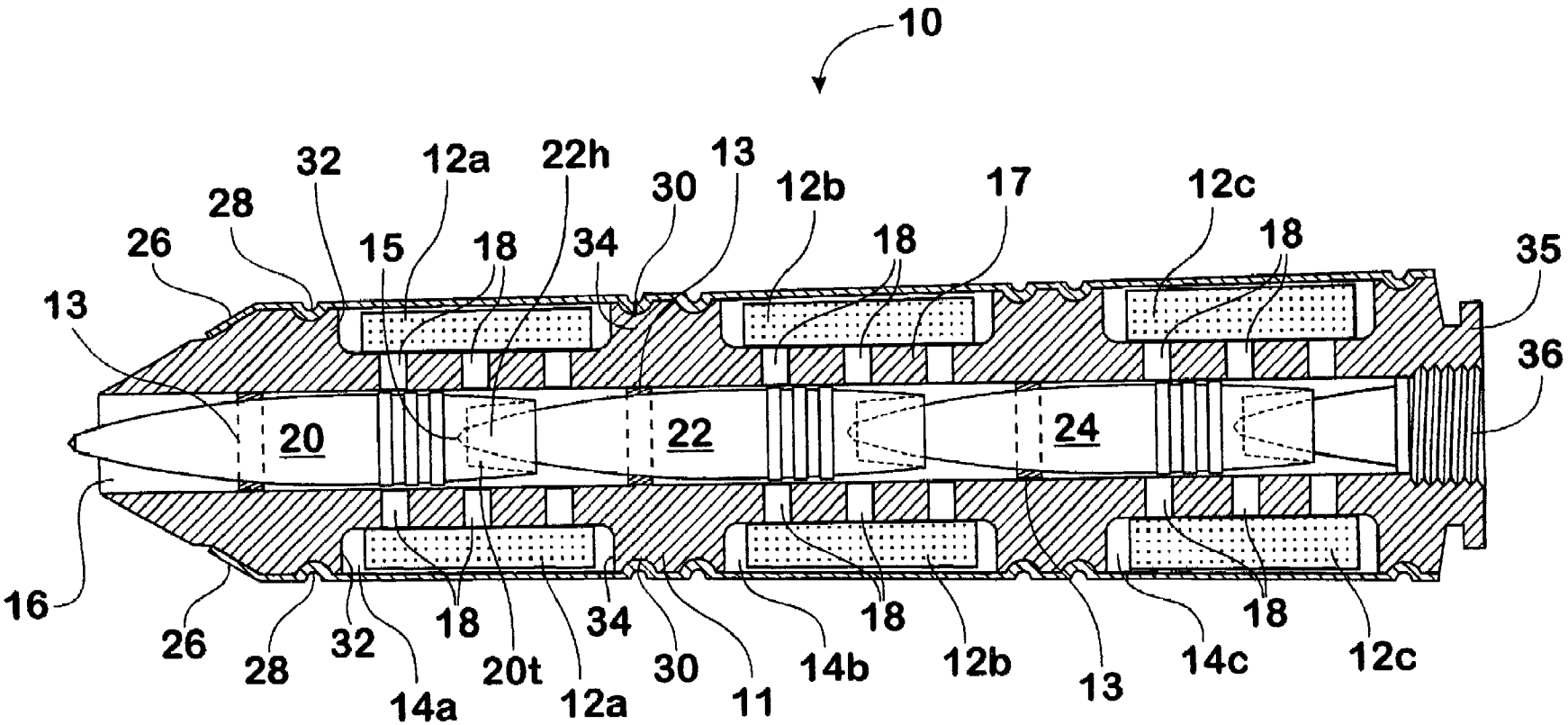
FIG. 1 depicts a cross-sectional side view of a cartridge assembly of a first embodiment of the invention, containing three projectiles and propellant charges.

FIG. 1 shows a cross-sectional view of a longitudinal aspect of a cartridge assembly 10 of one embodiment of the invention. This view shows a support body 11 of a substantially cylindrical configuration which tapers from a rear end 35 towards a forward end. The support body 11 partially defines a plurality of circumferential chambers 14, each chamber 14*a*, 14*b*, 14*c* containing a respective propellant charge 12*a*, 12*b*, 12*c*. The body 11 is preferably made of metal, but may be of any suitable material that can maintain rigidity under the influence of forces related to the rapid expansion of gases associated with the initiation or ignition of a propellant charge 12. A tubular wall portion of the support body also defines, at an inner surface thereof, a central longitudinal channel 16. Those expanding gases may be communicated from a chamber 14 into the central longitudinal channel 16 via fluid communication means, here in the form of a plurality of apertures 18 provided in the tubular wall portion 17 of the support body 11.

Three (3) projectiles 20, 22 and 24 are located in head to tail or stacked in abutting end-to-end orientation within the central longitudinal channel 16, wherein each projectile is located adjacent a respective chamber 14, i.e. projectile 20 is adjacent chamber 14*a*, projectile 22 is adjacent chamber 14*b* and projectile 24 is adjacent chamber 14*c*. Most suitably the head to tail abutments of the stacked projectiles are located adjacent the respective apertures 18 communicating between the channel 16 and the respective chambers 14.

The projectiles are, as stated, located head to tail, wherein such an arrangement keeps the length of the cartridge to a minimum. Assistance in keeping the projectiles coaxially aligned within the central channel 16 of the support body 11 so that they will be ready for firing into the also coaxially aligned barrel is not a necessity. Thus it is merely preferable that this alignment be maintained during transport and storage and up to its time of firing. In order to provide an alignment means, a small concave indent 15 is suitably provided centrally on a rear surface of each projectile into which the apex of the head of the projectile is located in abutting relation.

Yet further means of alignment can be provided by a burster disc (not shown) enclosing the entire nose of the projectile or by an annular stabilizing ring 13 located on the outer surface of each projectile, forward of its middle and abutting the surface of the central channel 16 (as shown in FIG. 1). The stabilizing ring might also be further adapted for sealing against the inner wall of the central channel to aid in resisting blow-by of expanding gases which might contribute to sympathetic initiation of rearward propellant charges.

The projectiles, such as frontmost projectile 20, also include a trailing hollow or recessed frost-conical shaped tail portion 20*t* which does not touch the outer surface of the head 22*h* of a following projectile 22. The tail portion 20*t* is provided for minimizing turbulence and stabilization during flight of the projectile 20.

In this first embodiment, a cylindrical sleeve 26 forms a radially outermost wall of the chambers 14*a*, 14*b* and 14*c*. The sleeve is made of metal and is suitable for mechanical fixing to the support body fore and aft of each the chambers. FIG. 1 illustrates one way in which the sleeve can be adapted to both firmly encapsulate the support body 11 and to serve as a chamber-forming element. Accordingly, FIG. 1 shows the cylindrical sleeve 26 tapering from the rear end 35 towards the forward end of the cartridge such that the sleeve 26 encapsulates the support body 11. The sleeve 26 forms the outer wall of the chamber spaces 14.

In order to provide a gas tight seal, referred to as the primary seal of the arrangement (as will be discussed later) the sleeve 26 is crimped 28 into annular grooves 30 which are provided in the radially outer surfaces of the annular wall portions fore 32 and aft 34 of the chamber 14*a*. The crimping technique is ideally also used, fore and aft of each of the chambers, including 14*b* and 14*c*. However, it is likely that a single crimp between chambers will suffice because the cartridge itself, during use in a firearm, is surrounded and supported by a breech or similar structure (not shown). In an alternative arrangement, O-ring type seals may be provided between the outer faces of the annular wall portions and the cylindrical sleeve forming the outer wall in order to seal the propellant chambers.

The breech of the firearm will be specifically shaped and constructed so as to steady the cartridge during firing, such as described later in relation to FIGS. 7 and 8.

The breech will also envelope the cylindrical walls of the cartridge assembly and assist the sleeve to resist the outward movement, particularly at the primary seals, that they will experience as a result of the rapid expansion of gases after ignition of the propellant 12 in the chamber 14 thus formed. Force in a direction along the barrel acting on the cartridge upon closure of the surrounding and supporting breech together with the taper shape of the support body generate a radial compression force enveloping the cartridge. This radial force assists the primary seals resist the relatively massive expansionary forces of the gases produced by the combustion of the propellant 12. For example, the radial force on the outer wall (i.e. sleeve 26) further assists the outer wall resist the outward movement at the primary seals. This radial force also further assists the outer wall (i.e. sleeve 26) provide the containment barrier for the products of gaseous expansion of propellant.

In another embodiment, not depicted, the outer wall may be integrally formed with the support body, i.e. the same metal as the support body will form the cylindrical outer wall of the cartridge assembly. Access to the chambers for placement of the propellant is dependent on the type of propellant to be used in the cartridge. It is possible to provide a salable aperture in the outer wall through which the propellant can be inserted into the chamber along with a suitable ignition means.

The ignition means has not been specifically described since it is a matter of choice dependent again on the propellant to be used in the cartridge assembly, but may include for example a primer. In one arrangement, primers for the propellant charge in each chamber may be triggered externally via salable apertures (not shown) provided in the outer wall of the cartridge. The apertures allowed 20 mm "Cannon" electric primers inserted into a breech unit to fire into the propellant thereby providing ignition for the propellant as required.

Clearly different types of propellant will be chosen on the basis of a number of requirements, not the least being the forces desired to be generated by their ignition that will consequently eject a projectile at a desired velocity. Other considerations include the volatility of the propellant for the conditions of use of the cartridge including storage and transportation. Yet another requirement will be its form, i.e. whether liquid, gas, gel or powder, and whether the propellant is suitable for the process of encasement in the chamber.

Electrical control of ignition is possible in a variety of ways known in the art, such that as an example, all of the projectiles are ejected within a predetermined interval determined by the timing of the ignition signals sent by control apparatus.

The ignition signals may be in the form of trigger pulses synchronized to be transmitted to the primers at the required time intervals. The pulses are synchronized by a master timer in the control apparatus that switches respective firing pulse output circuits. The firing pulse output circuit for each primer includes a charge storage device that remains charged until the master timer generates a trigger pulse for the required firing pulse output line. The trigger pulse causes a transistor to conduct, thus closing the output circuit causing the charged output capacitor to discharge through the primer.

In experimental cartridge arrangements constructed for testing the invention, commercially available gun propellant 12 was encased in the chambers by obturation of the apertures 18. The obturation means comprised a couple of layers of foil tape (not shown) wrapped around the outer surface of the tubular body portions of the support body 11 and over the apertures, i.e. within each of the chambers 14. Two (2) layers of "Scotch" brand self adhesive aluminum tape having a measured thickness of 0.11 mm was employed. This tape was chosen to provide some small level of temperature and 'flash' protection, and a small level of 'shot start pressure' to ensure good propellant burn.

Such a propellant arrangement was chosen because of its ready availability and the need to determine maximum projectile velocities. Further the encased propellant was chosen to minimize the effect of premature ignition by gases that may blow back from an ignition associated with the ejection of a forwardly located projectile, even assuming the encasement method alone should not resist the blow-back pressure and temperatures.

An alternative proposed arrangement is to encase the propellant charge in a metal foil bag having an annular form to fit snugly within the annular chambers provided. The foil was folded back over the propellant such that the free ends were remote from the apertures provided in the body of the cartridge. In this bag configuration, the metal foil is self-sealed by external pressure.

The encasement of the propellant during the life of a cartridge assembly up until use may be important in certain conditions. If it is anticipated that the cartridge assembly will be stored in uncontrolled environments, such as high humidity and the propellant has hydrophilic properties, those conditions may render the propellant inoperative at the moment of required ignition, it is important to appropriately seal the propellant charges.

In most circumstances the propellant encasement method will require the propellant to burn through the tape or bag material and as such the effect of blow back pressures and even those gasses having accompanying high temperatures will be insufficient to prematurely ignite the encased propellant.

Figure 2:
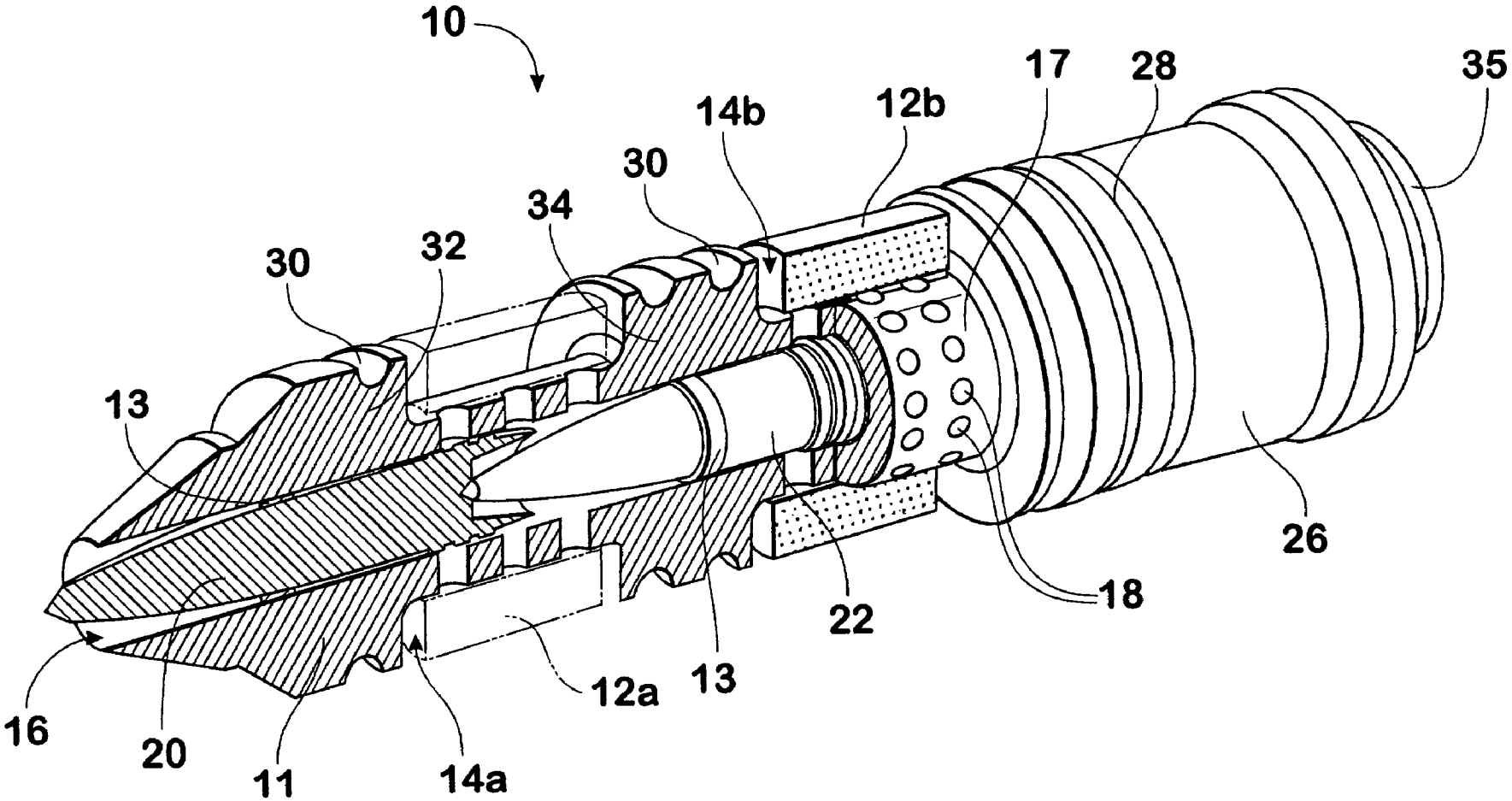
FIG. 2 depicts a partially cut-away and phantom perspective view of the cartridge assembly of the first embodiment.

Some of the apertures 18 provided in the tubular wall portion forming the radially inner wall of the chamber are shown in cross-section in FIG. 1. However, as illustrated in FIG. 2, the apertures 18 are arrayed about or distributed over the whole of the tubular wall portion 17 in a grid like fashion. It is anticipated that some variation of the grid may be advantageous, not only in its spacing and configuration, but also in the number of apertures and angle through the tubular wall portion. The exit of the apertures 18 into the central channel 16 is located, in this embodiment, about the rear portion or tail of a respective projectile.

After the propellant is ignited, the gases produced initially expand in all directions testing the sealing of the outer wall, i.e. sleeve 26, of the chamber 14. Those crimp seals 28 are, in the present embodiment, the primary seal resisting the relatively massive expansionary forces of the gases produced by the combustion of the propellant 12 initially and during the complete process of combustion. Even when the chambers are integrally formed in the wall of the cartridge assembly body, the cylindrical chamber 14 housing the propellant charge 12 is the primary location for that resistance.

Rapidly expanding gasses will tend to move and take a path of least resistance and the apertures 18 provide such a path. Initially the velocity of the gases escaping from the apertures will be less than will exist shortly thereafter once the propellant reaches its maximum combustion state. It is during the initial phase of the combustion process that the projectile associated, in positional terms, with the apertures from which the gases are escaping will begin its forward movement out of the cartridge and into the barrel of the firearm. The velocity of the gases escaping into the central chamber 16 through the apertures is less initially and reaches a maximum near the peak expansive phase of the propellant combustion.

As the projectile moves forward, it leaves a larger volume behind it and into that larger volume and its associated lesser pressure will quickly follow the gases expanding out of the chamber via the apertures. The projectile is thus moved at an increasing rate out of the cartridge reaching maximum velocity somewhere along the barrel before exiting the muzzle and being immediately affected by the external atmosphere during its now directed trajectory.

The rearward forces associated with gaseous expansion that moves rearward along the central channel of the cartridge are relevantly less than those associated with the forces experienced within the chamber but nonetheless are in existence. In some way the ring 13 provides resistance to the rearward passage of the gasses, but in any event the location of and the encasement of the nearest propellant charge is such that any gasses that do pass the projectile will not prematurely initiate the propellant associated with that rearward projectile.

The rear end 35 of the cartridge assembly 10 includes a screw threaded cap or plug 36 for providing a rear wall for the central channel 16 that forms the rearmost volume for the gasses to enter prior to ejecting the last projectile 24.

Figure 3:
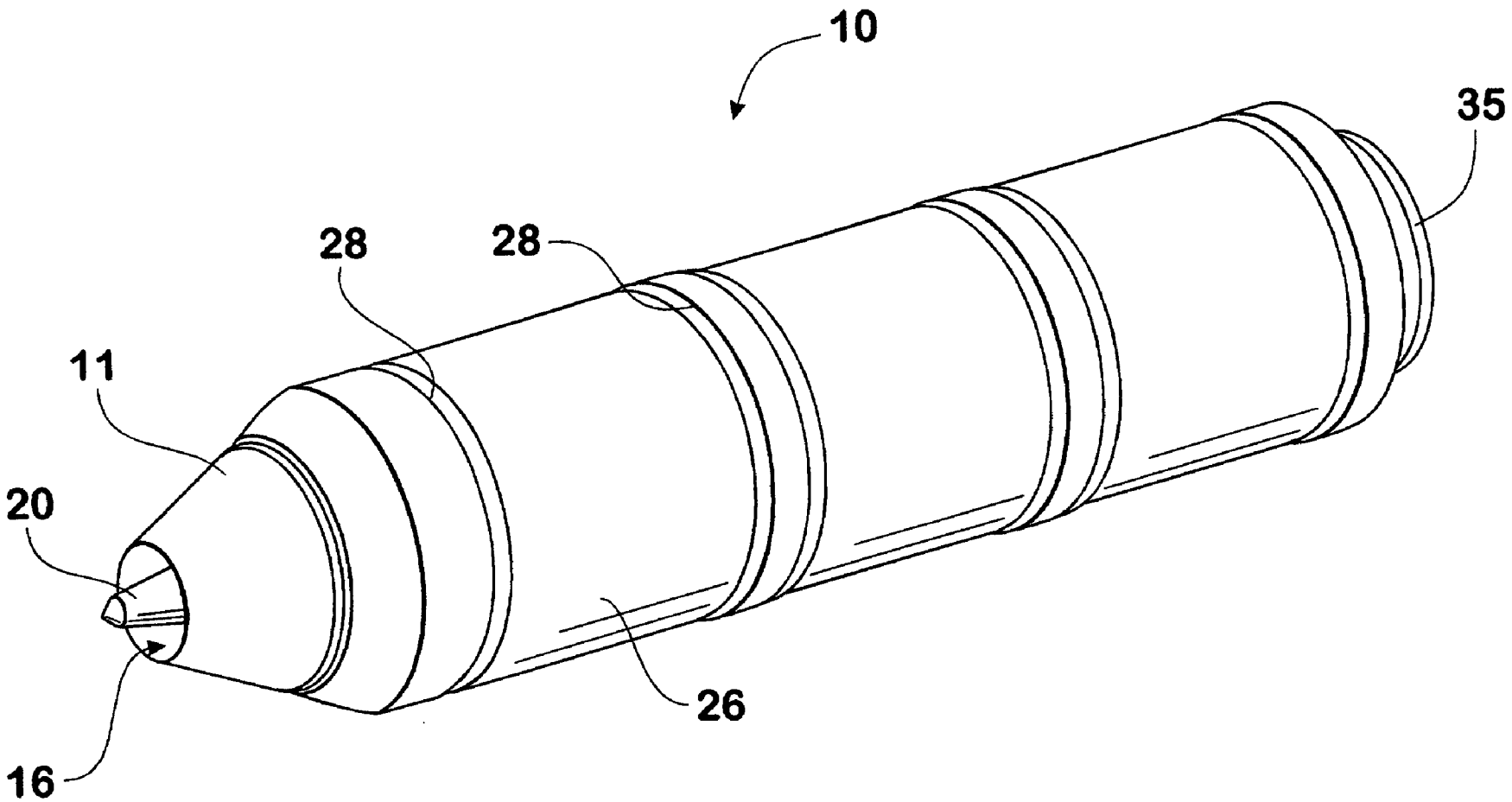
FIG. 3 depicts a perspective view of the exterior of a jacketed cartridge assembly.

FIG. 2 depicts a partial breakaway view of a cartridge assembly 10 showing the features of the chambers 14*a*, 14*b* and associated apertures 18 along with the external shape and configuration of the sleeve 26 that encases the cartridge. Like features are identified by like numerals to those associated with FIG. 1, as is also the case for FIG. 3 which depicts a fully encased cartridge.

Figure 4:
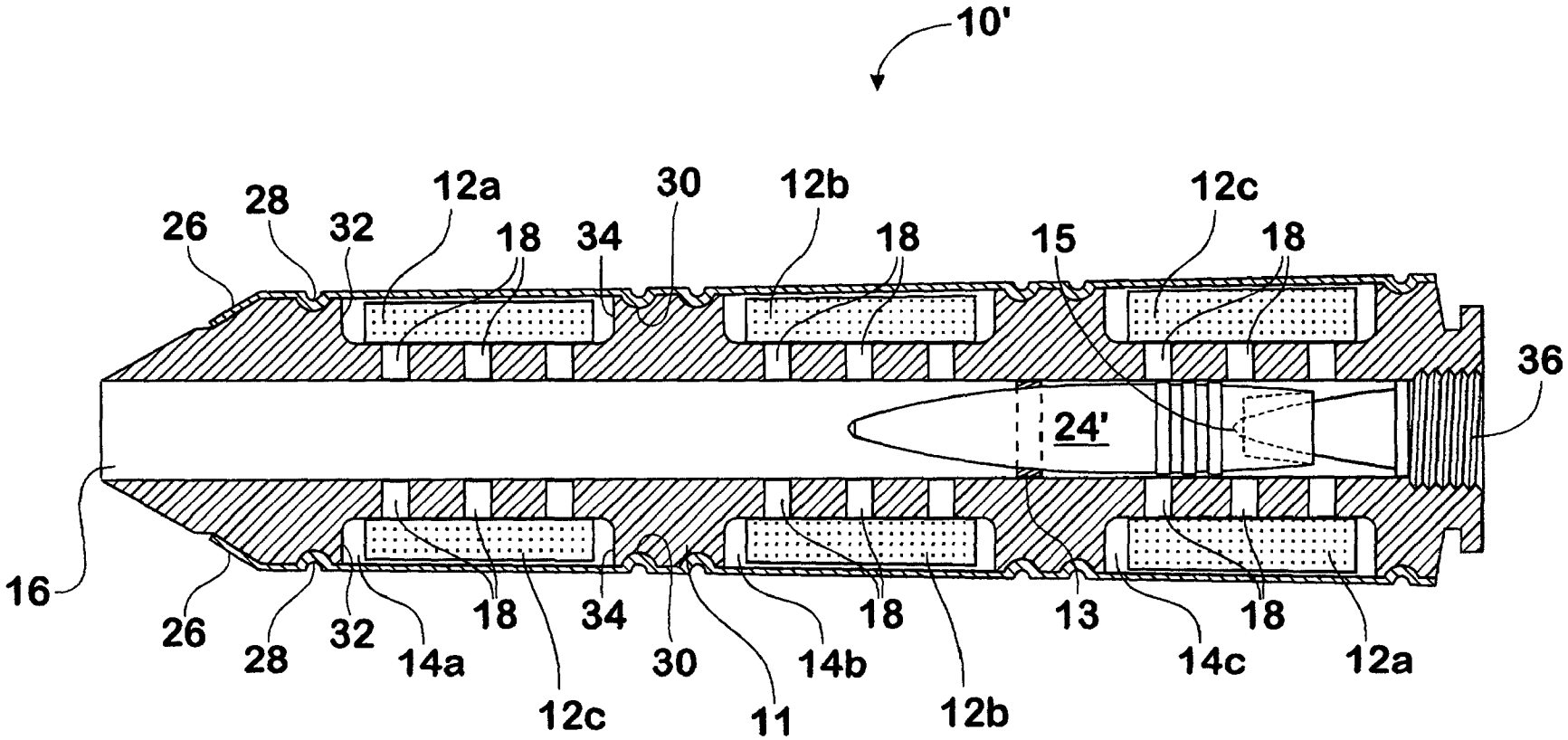
FIG. 4 depicts a cross-sectional side view of a cartridge assembly of a second embodiment of the invention, containing a single projectile and three propellant charges.

A cartridge assembly 10 of second embodiment of the present invention is depicted in FIG. 4. In this embodiment, only a single projectile 24' is loaded onto the central longitudinal channel 16 of the cartridge support body 11. The projectile 24' is aligned at its tail by a forward (projectile nose shaped) extension of the end plug 36 which locates in the concave indent 15 provided in the hollow tail portion of the projectile, whilst an annular stabilizing ring 13 encircles a forward portion of the projectile.

In operation, the propellant charge 12*c* in the cavity 14*c* adjacent the tail of the projectile 24' is initiated first. Then, as described above, projectile is caused to travel forward along the channel by force exerted on the projectile 24' by the expanding gasses. Upon the projectile reaching a position adjacent the second cavity 14*b*, such as may be exemplified by reference to projectile 22 in the first embodiment (see FIG. 1), the second propellant charge 14*b* is initiated. This will add to the forces acting upon the moving projectile 24', with a similar initiation of the third propellant charge 14*a* occurring when the projectile 24' is adjacent the third and last cavity 14*a*.

The result is a projectile 24' that has a higher muzzle velocity and kinetic energy that is not only higher than that employing a single similar propellant charge, but which is adjustable in a number of discrete steps. For example, an intermediate muzzle velocity is available by firing only two (2) of the three available propellant charges 14*a*, 14*b* and 14*c*. The remaining charge can, in this scenario, be expended for safety reasons shortly after the projectile 24' has exited the barrel of the firing weapon.

This selection of projectile energy provides added flexibility to operation of the cartridge assembly 10'. A cartridge of this type will find application in cartridges employed in relatively high pressure firearms and weapons applications, usually where high velocity projectiles are required such as in sniper rifles, ship defense weapons and armor piecing rounds for anti-armor use.

Figure 5:
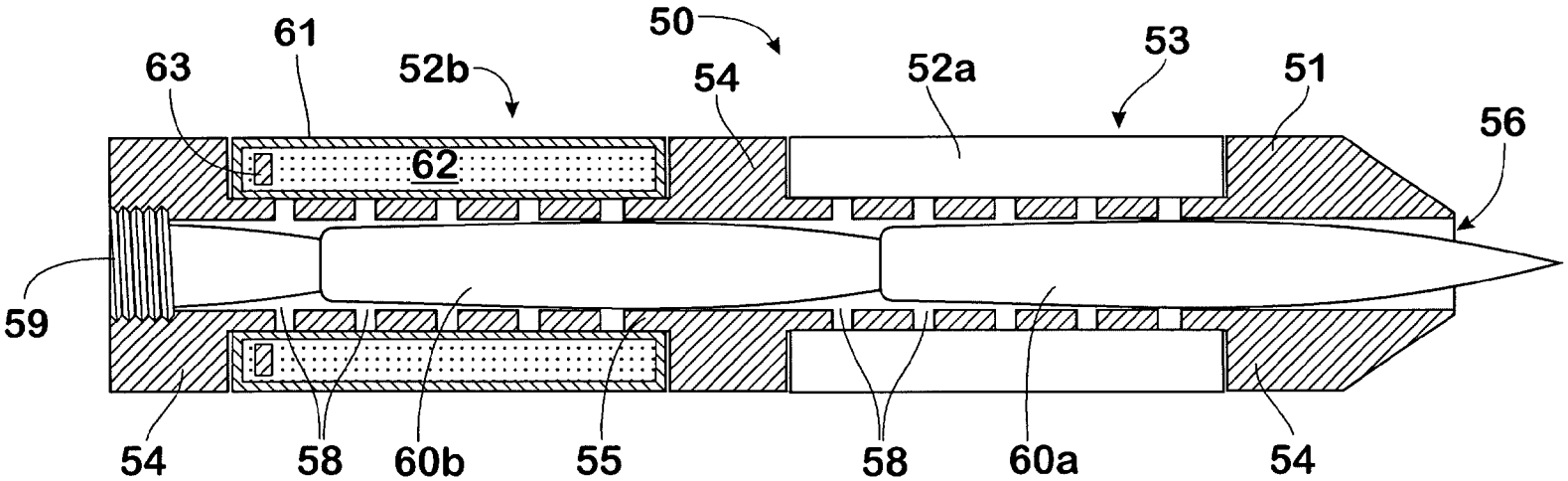
FIG. 5 depicts a cross-sectional side view of a cartridge assembly of a third embodiment of the invention, containing two projectiles.
Figure 6:
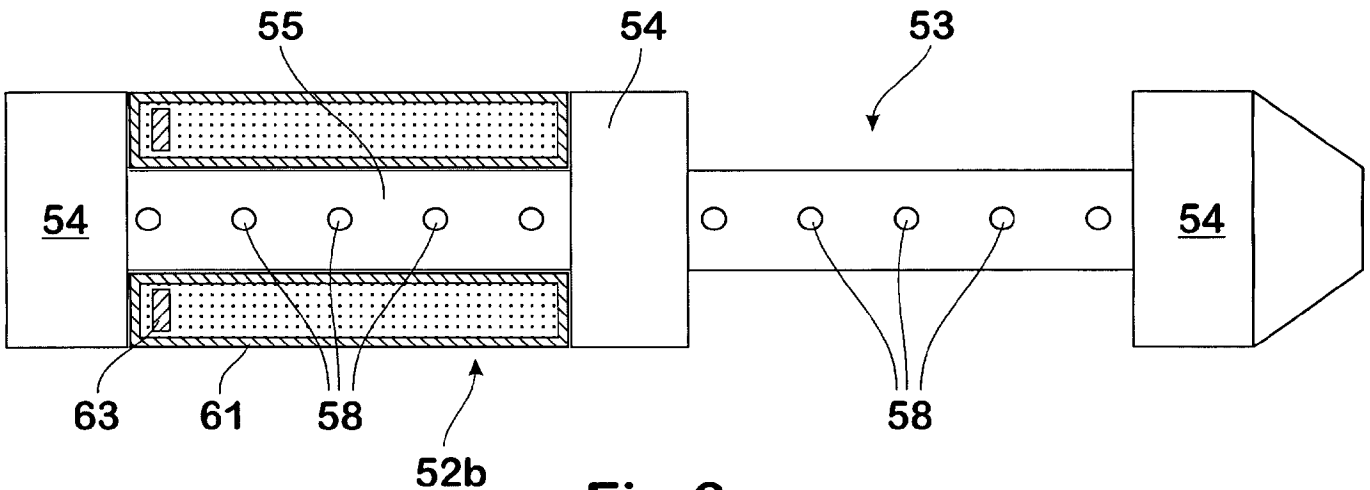
FIG. 6 depicts a top plan view of the cartridge of the third embodiment, with the projectiles and a forward propellant charge removed.

In FIGS. 5 and 6, there is shown a cartridge assembly 50 of a third embodiment of the invention. The assembly includes a longitudinal support body 51 which partially defines circumferential chambers 53 for housing propellant charges 52. End walls of the circumferential chambers are formed by annular wall portions 54 of the support body 51, which wall portions extend outwardly from a tubular wall portion 55 of the support body. The tubular wall portion 55 defines, at an inner surface thereof, a central longitudinal channel 56 in which is located projectiles 60. The rear or breech end of the channel 56 is closed by a screw threaded cap 59, which includes support structure for the rearmost projectile 60*b*. The tubular body 55 further includes a plurality of fluid communication means, in the form of ports 58, for communicating expanding gasses from the respective chambers 53 when a propellant charge 52 is initiated.

In the present embodiment, each propellant charge 52 includes a volume of propellant material 62 encased in a bag 61, suitably constructed of materials including a metallic foil. The bags have the desirable property of being resistant to external impingement by expanding gases, whilst readily bursting upon initiation of the propellant material 62 by an igniter 63 disposed within the bag 61. The bags 61 are suitably disposed in a respective circumferential chamber, being wrapped around the tubular wall portion 55 including the longitudinal arrays of ports 58. It will be noted that the forward propellant charge 52*a* has been omitted from the external view of the cartridge assembly shown in FIG. 6, for reasons of clarity.

Figure 7:
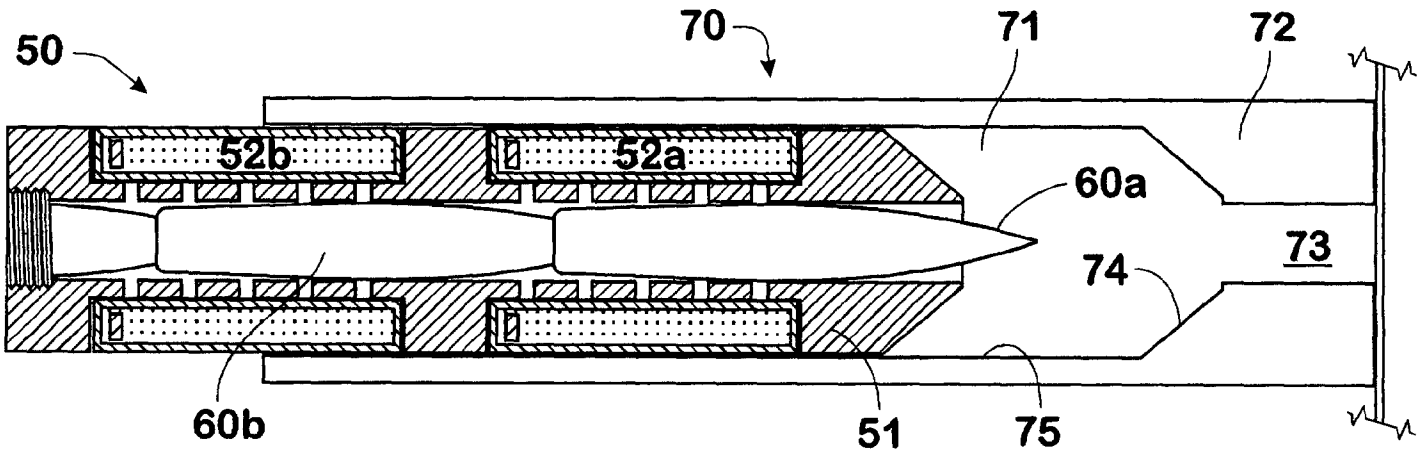
FIG. 7 depicts a cross-sectional view of the cartridge assembly of the third embodiment partially loaded into the breech of a firearm.
Figure 8:
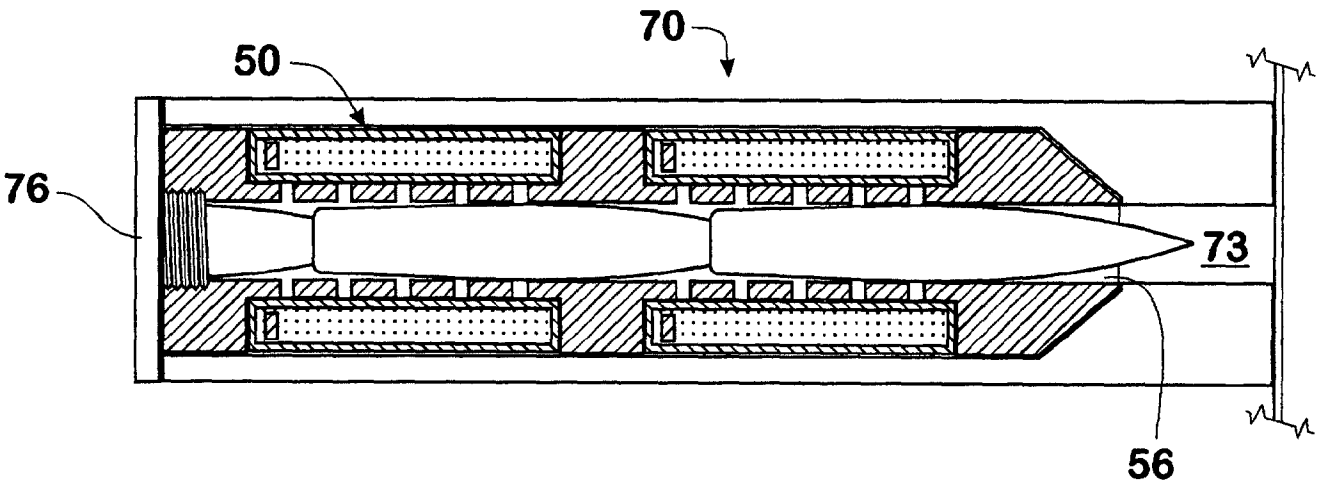
FIG. 8 depicts a cross-sectional view of the firearm of FIG. 7, with the cartridge assembly fully engaged in the breech.

A breech end of a firearm 70 for receiving a cartridge assembly is depicted in FIGS. 7 and 8. The firearm 70 includes a breech chamber 71 and a barrel 72, of which only a fragment is shown, having a bore 73. Whilst there will be several different methods for loading the cartridge assembly 50 into the breech chamber of firearms for coaxial alignment with the barrel of the firearm (including side loading), a rear loading arrangement is depicted in the drawings.

Figure 9:
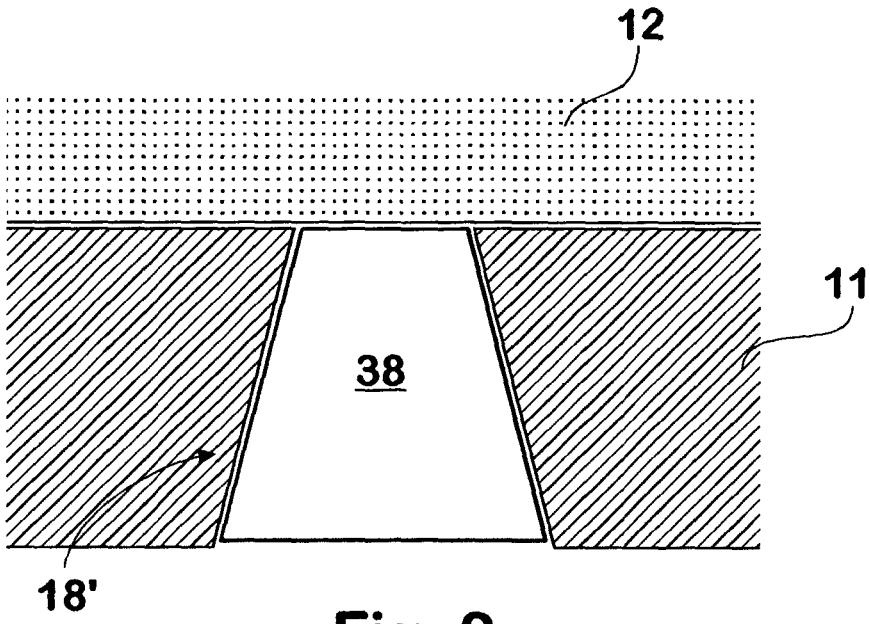
FIG. 9 depicts an enlarged cross-sectional view of an aperture of a cartridge support body containing an obturation plug.

The breech chamber includes at a forward end, a tapered surface 74 for engagement with the tapered nose portion of the support body 51 of the cartridge assembly 50. The tubular internal wall 75 of the breech chamber 71 is also sized to closely envelope and support the outer circumference of the cartridge assembly 50. The cartridge assembly 50 is, after full insertion as depicted in FIG. 8, then sealed inside the breech chamber 71. A hinged door 76 is attached to the rear of the firearm 70 utilizing a cammed hinge arrangement (not shown), such that the door 76 can open on a hinge to allow insertion of a fresh cartridge assembly and retraction of a spent cartridge assembly A further arrangement to minimize the effect of gases that may blow back from an ignition associated with the ejection of a forwardly located projectile is depicted in FIG. 9. In this arrangement, further sealing of the propellant chamber containing a propellant charge 12 is provided by obturation means in the form of a frusto-conical shaped plug 38 that is wedged into correspondingly shaped apertures 18' provided in the tubular wall portion of the support body 11. The plugs 38 are each arranged to enhance the seal in the aperture 18' when exposed to gas pressure external of the propellant chamber, i.e. coming from within the central channel containing the projectiles (not shown). However, when exposed to pressure from within the propellant chamber, generated by the initiated propellant charge 12, the plug 38 will be expelled from the aperture. The plugs 38 are suitably composed of a material that is consumed by burning propellant, such that minimal residue from the plugs remains in the cartridge or in the barrel of a firearm. Suitably the surface of the plugs exposed to the central channel may be coated with a combustion resistant material.

In order to provide each projectile with more than one propellant volume, the circumferentially disposed propellant volume of the embodiments described above (which is completely wrapped around the tubular wall portion of the cartridge support body) is broken into smaller propellant sections. If three (3) separate propellant volumes are desired then the propellant chamber is divided into three smaller subchambers The embodiment depicted in FIG. 10 having each utilizing around 120 degrees of the available original circumferential chamber. This embodiment is depicted in the cross-sectional end view of the cartridge 80 in FIG. 10.

Figure 10:
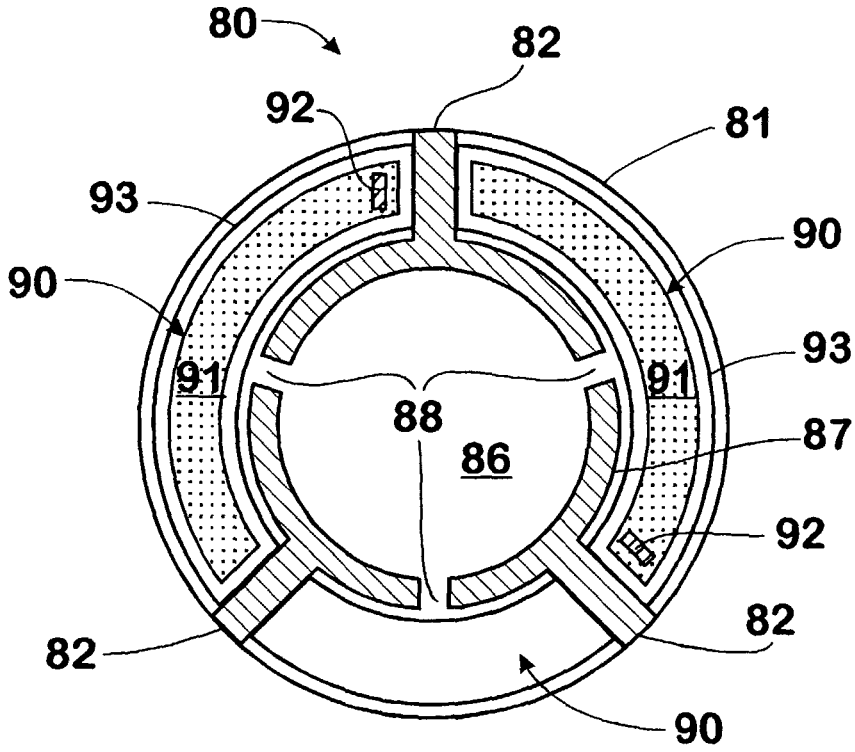
FIG. 10 depicts a cross-sectional end view of a cartridge support body, including sector portions of propellant charge.

The cartridge support body 81 includes three (3) propellant sub-chambers 83, 84,85 formed in the embodiment depicted in FIG. 10, by radially extending side walls 82 that divide the circumferential chamber into three (3) sectors. Each sub-chamber contains a smaller propellant charge 90, comprising a propellant volume 91 and associated igniter 92 encased in an individual bag 93. The sub-chambers each communicate with the central channel 86 via a longitudinal array of apertures or ports 88 provided in the tubular wall portion 87 of the support body 81. As described above in respect of annular wall portions fore 32 and aft 34 of the chamber 14*a*, any outer wall such as e.g. sleeve 26 is sealed against radially outer walls of the side walls 82. Alternatively, as described above, the side walls 82 are integrally formed with the outer wall, or the side walls 82 may seal against the inner wall of the breech chamber.

Where each of the three (3) smaller propellant charges 90 is provided with a separate primer, a firing control computer can determine how many propellant volumes are to be initiated depending on the desired ballistic solution and the kinetic energy thus required. The smaller charges may be fired together, or in a staggered sequence as discussed above in relation to the second embodiment of the invention.

If required, any unused propellant charges associated with forward projectiles could be employed as travelling charges for later fired rearward projectiles.

A variety of materials could be used for constructing the cartridge assembly of the invention, other than metal. For example a re-load cartridge could be made of a lightweight composite material and simply discarded after use. The propellant bags and sealing plugs could also be constructed of composite or suitable materials other than metallic foils.

It is anticipated that sabot technology will provide for further increases in velocities of projectiles.

It is further anticipated that a cartridge assembly according to the invention can be made of dimensions to suit almost any size of projectile suitable for firing through a suitably proportioned barrel of a firearm. That is, projectiles of 0.22 caliber or projectiles referred to as 80 mm rounds can be accommodated in a cartridge assembly by suitably scaling the relevant elements of the invention. Clearly the cartridge feed mechanisms of respective firearms will need modification to accommodate the generally longer, radially larger and heavier cartridges.

The caliber of firearms and projectiles is expressed in various ways. Cannons are often designated by the weight of a solid spherical shot that will fit the bore, for example a 12-pounder. Pieces of ordnance that project a shell or hollow shot are designated by the diameter of their bore, e.g. a 12 inch mortar or a 14 inch shell gun. Small arms are designated by hundredths of an inch expressed decimally, such as a rifle of 0.44 inch caliber. In other examples the outer diameter of the projectile or the inner diameter of the barrel of the firearm is referred to in millimeters or thousandths of an inch.

It will be appreciated by those skilled in the art that the invention is not restricted in its use to the particular application described. Neither is the present invention restricted in its preferred embodiment with regard to the particular elements and/or features described or depicted herein. It will further be appreciated that various modifications can be made without departing from the principles of the invention. Therefore, the invention should be understood to include all such modifications within its scope as defined in the claims which follow.

The invention claimed is:

1. A cartridge assembly including:

a support body having a central longitudinal channel housing a plurality of projectiles in end-to-end orientation and having a plurality of chambers arranged around the central longitudinal channel, wherein each chamber houses several propellant charges and is located adjacent to a respective projectile;

a plurality of sub-chambers formed in each chamber for accommodating a respective propellant charge of said several propellant charges, each propellant charge can be individually initiated and is associated with an initiator for the individual initiation of the propellant charge;

an aperture included in the support body for communicating the products of a gaseous expansion of said propellant from a respective sub-chamber into said central longitudinal channel;

whereby, upon initiation of a selected propellant charge, the communicated products of gaseous expansion from a chamber force or eject a respective projectile from the cartridge assembly.

2. The cartridge assembly of claim 1 further including a tubular wall portion of the support body for defining, at an inside surface, the central longitudinal channel.

3. The cartridge assembly of claim 2 wherein the aperture comprises a port provided in the tubular wall portion of the support body.

4. The cartridge assembly of claim 1 wherein the support body has transverse annular walls forming ends of said circumferential chambers.

5. The cartridge assembly of claim 1 wherein the support body has radially extending side walls dividing each circumferential chamber into the several sub-chambers.

6. The cartridge assembly of claim 1 wherein the initiator is an igniter and each sub-chamber contains a propellant charge comprising a volume of propellant material and igniter encased in an individual bag.

7. The cartridge assembly of claim 1 wherein each chamber extends fully around the central longitudinal channel.

8. The cartridge assembly of claim 7 wherein each chamber is divided into sectors to form the sub-chambers.

9. The cartridge assembly of claim 1 wherein the support body is unitary.

10. The cartridge assembly of claim 1 wherein the propellant charges are sealed in their respective chambers by an obturator.

11. The cartridge assembly of claim 10 wherein the obturator is burstable upon ignition of the respective propellant charge.

12. The cartridge assembly of claim 1, wherein the cartridge assembly is for engagement with a breech chamber.

13. The cartridge assembly of claim 12, wherein the support body is shaped for engagement with the breech chamber.

14. The cartridge assembly of claim 13, wherein the support body is at least partially tapered.

15. The cartridge assembly of claim 12, wherein the support body is for engagement with the breech chamber to thereby support the cartridge during firing.

16. The cartridge assembly of claim 1, wherein the assembly includes a cover about the support body to close off radially outward opening the chambers.

17. The cartridge assembly of claim 16, wherein the assembly is for engagement with a breech chamber for resisting outward movement of the cover during firing.

18. The cartridge assembly of claim 1, wherein radially outward opening of the chambers are closed off by an outer wall integrally formed with the support body.

19. The cartridge assembly of claim 18, wherein the assembly is for engagement with a breech chamber for resisting outward movement of the outer wall during firing.

20. The cartridge assembly of claim 1 further including a stabilizing ring located on the outer surface of each projectile and abutting the support body.

21. The cartridge assembly of claim 1 further including a sealing ring located on the outer surface of the projectile and abutting the support body.

22. The cartridge assembly of claim 1 wherein the projectiles abut.

23. A cartridge assembly including a support body having:

a central longitudinal channel housing a plurality of projectiles in end-to-end orientation;

a plurality of chambers arranged around the central longitudinal channel, wherein each chamber has a plurality of sub-chambers formed for accommodating a plurality of propellant charges and is located adjacent to a respective projectile, each propellant charge can be individually initiated and is associated with an initiator for the individual initiation of the propellant charge; and apertures for providing fluid communication between the respective sub chamber and the channel whereby, upon initiation of a selected propellant charge, the communicated products of gaseous expansion from a chamber force or eject a respective projectile from the cartridge assembly.

* * * * *